US006164391A

United States Patent [19]

Wurm

[11] Patent Number: 6,164,391

[45] Date of Patent: Dec. 26, 2000

[54] FIXTURE FOR THE PRODUCTION OF BORES WITH SINGLE OR DOUBLE RODS

[75] Inventor: Thomas Wurm, Wenden, Germany

[73] Assignee: Klenn Bohrtechnik Zweigenieder Lassung der Bauer Spezialtiefbau GmbH, Drolshagen, Germany

[21] Appl. No.: 09/266,034

[22] Filed: Mar. 11, 1999

[30] Foreign Application Priority Data

Mar. 12, 1998 [DE] Germany ..... 198 10 707

[51] Int. Cl.[7] ..... E21B 19/14

[52] U.S. Cl. ..... 175/52

[58] Field of Search ..... 175/45, 52, 61, 175/62, 75, 73, 101, 107, 103, 171, 172, 173, 170; 405/258, 262, 260, 284

[56] References Cited

U.S. PATENT DOCUMENTS 4,051,911 10/1977 Cherrington .

4,718,791 1/1988 Weatherby .

FOREIGN PATENT DOCUMENTS 0 397 187 1/1990 European Pat. Off. .

0 527 460 8/1992 European Pat. Off. .

*Primary Examiner*—Robert E. Pezzuto

*Attorney, Agent, or Firm*—James Creigthon Wray; Meera P. Narasimhan

[57] ABSTRACT

For producing bores, a fixture is used on which one of the vise-grip wrenches 10 can travel in the longitudinal axis 17 of the clamping mount 2 and is correspondingly arranged in a movable way with the swiveling and traversable drum magazine 6. The interior 9 and exterior tubes 8 can be removed radially from the drum magazine 6 and are held by clamps 27, 28, with the swiveling and traversable drum magazine 6 being equipped with a clamping roller design 20 which raises the interior tubes 9 and lowers them into the exterior tubes 8 so that they, in combination, can then be swiveled into the drilling axis 26 in order to be connected with the existing boring rod.

21 Claims, 5 Drawing Sheets

FIXTURE FOR THE PRODUCTION OF BORES WITH SINGLE OR DOUBLE RODS

BACKGROUND OF THE INVENTION

The invention concerns a fixture for the production of bores with a clamping mount, driving gears that are traveling along this mount via which the boring rod, which consists of interior tubes and exterior tubes, is driven into the bore or also pulled out, and a drum magazine for the interior and exterior tubes that is arranged parallel to the clamping mount, traversable around the axis of rotation and swiveling around the clamping mount's longitudinal axis, as well as vise-grip wrenches allocated to the clamping mount for tightening and loosening the boring rod.

Such fixtures have a crawler, on which a clamping mount is arranged on articulating arms and can be moved in various directions. A movable driving gear is arranged on this clamping mount with which the interior tube and the exterior tube can be fed in order to be able to drive both either simultaneously or individually into the soil, or to be able to pull them back out of the soil together. The interior and exterior tubes used for further operation of the fixture are connected with those tubes that were already assembled into a drill string, with vise-grip wrenches being allocated to the clamping mount which hold the last tube of the drill string in place or appropriately turn the tube to be connected. Drum magazines used for inserting the individual tubes of a boring rod are known for both boring with single tube rods and double tube rods. While during drilling with individual tubes they are taken out of the drum magazine and can travel via the driving gear in the direction of the fixed boring rod, the work involved in inserting or taking out the double tube rod is considerably more extensive. From EP-A1-0 379 187 we know of a procedure and a fixture whereby holding devices for the exterior and interior tubes are allocated to the rod magazine. In doing so, the tubes, which are inserted into each other, are kept in the rod magazine as a double rod pipe and arranged in such a way that via a fastening element the interior rod always protrudes from the exterior rod or exterior tube. This makes it possible for a lifting device to take hold of both tubes simultaneously and either swivel them into the drilling axis' direction or swivel and turn the rod magazine appropriately so that the respective double tube can be removed. The insertion process of the two tubes becomes difficult when they are pulled out of the drilled hole and inserted into the rod magazine separately because the driving gear is required for this operation. EP-B1-0 527 460 describes a procedure and a drilling tool whereby the drum magazine consists of two separate magazines that are arranged on top of each other, from which the individual tubes are accordingly removed one after the other. A disadvantage of this of course is the fact that the individual magazines are arranged on top of each other, resulting in unfavorable weight distribution for the overall equipment. This is a major contributing factor to the fact that only relatively short tubes are utilized, which causes frequent exchanges of rods. For this, the two drum magazines are swiveled from a somewhat outer position into working position so that they can be turned to enable removal of the respective interior or exterior tube. After the appropriate tube has been removed, the magazine must be returned into its storage position. The work involved in doing this is considerable.

The invention is therefore based on the task of creating a bore or hole drilling fixture wherein the interior and exterior tubes can be stored separately in a drum magazine, but also can easily be used jointly, without placing the stability of the mount or the entire drilling tool at risk during the individual manipulations.

SUMMARY OF THE INVENTION

According to the invention the task is resolved by arranging a vise-grip wrench on the lower end of the clamping mount that can travel in the mount's longitudinal axis and accordingly be actuated with the swiveling and traversable drum magazine, with the interior and exterior tubes being removable radially from the drum magazine and allocated while being held in place with clamps, and with the drum magazine being equipped with a clamping roller design for raising and lowering the interior tubes.

With a fixture of this design, it is possible to work with both single and double tube rods without making it necessary to change or exchange the drum magazine or other parts of the drilling device. Particularly when working with the double tube rod, it is beneficial that each individual interior tube and each individual exterior tube can be stored separately in the drum magazine in order to be able to be joined with other tubes, when required, and arranged in the drilling axis—by swiveling and turning the drum magazine—in such a way that a connection with the existing double tube string can be created with the help of common devices such as a driving gear and a vise-grip wrench. The vise-grip wrench, which travels in the longitudinal axis of the clamping mount, takes the appropriate tubes or double tube out of the drum magazine so that they can be "processed" in the respective position. Each individual tube, and thus also the interior and exterior tubes that are inserted into each other on the outer circumference of the drum magazine, are therefore easily accessible for the vise-grip wrench and other auxiliary devices and can be taken out of the drum magazine, as mentioned above, or stored there appropriately when pulling the boring rod. It is particularly beneficial that no separate grippers or no separate crane is required to insert the interior and exterior tubes into each other, and also the drilling heads do not have to be actuated, but rather the interior tubes are lifted out of the drum magazine and lowered into the exterior tubes. The interior and exterior tube combination is then brought into the drilling position and connected with the existing boring rod as described.

An advantageous version of the invention provides for the vise-grip wrench to be arranged on the clamping mount via a guided path of 1 to 2 meters, preferably 1 m. This version makes it possible to bring the vise-grip wrench into as favorable a position as possible for taking the double tube, or perhaps also the individual tube, out of the drum magazine and to fasten it in the drilling position so as to then be able to connect it with the existing drill string.

Another advantageous version is one wherein the clamps, which fasten the boring rod in the drum magazine, are arranged and designed in such a way that, from a radial perspective, the interior and exterior tubes are distributed separately or in distinct groups over the drum circumference. Since as a rule the interior tubes are pulled first when pulling the drill string, they can be arranged in the drum magazine in the shortest possible path. Afterwards, the exterior tubes are pulled one after the other, which can also be arranged in the drum magazine in the shortest possible path, so that these operations are quickly carried out. During insertion of the interior and exterior tubes, this design involving individual tubes or the boring rod in the drum magazine also offers the advantage that the tubes can be removed from the drum magazine and inserted into each other without impeding other tubes.

According to one version of the invention, the vise-grip wrench traveling in the clamping mount's longitudinal axis can be actuated via clamping cylinders that are arranged parallel to each other and one of which has a deviating device. This particular version offers the possibility of swiveling the drum magazine into the drilling axis without being obstructed by the second clamping cylinder of the vise-grip wrench in order to remove the double tube or also the individual tube from the magazine. The deviating device ensures that the cylinder has the necessary force to hold the double tube or individual tube from the drum magazine in place and fasten it in the drilling axis in such a way that it can be easily connected to the existing drill string.

According to the invention, the deviating device is equipped with an elbow, which includes one of the clamping jaws and is connected with the piston of the clamping cylinder in an articulating design. This way, a common clamping cylinder can be used to bring the clamping jaw into the respective position, secured against unfavorable forces by the elbow. The elbow is first connected with the clamping cylinder and second with the clamping jaw, with the articulating or movable connection eliminating or balancing the influence of angular forces.

Additionally it is planned that the elbow is connected with the piston via a pin and includes elongated holes in the angle arc. This prevents constraints when moving the elbow back and forth or when moving the piston up or down. This design ensures even and safe pressing of the clamping jaw against the respective tube, whether it is an interior or an exterior tube. It must be noted that the interior and exterior tubes have considerably different diameters. Accordingly, the path of the elbow, or preferably that of the clamping cylinder is different as well. Both the guidance and the articulating connection with the clamping cylinder's piston prevent interlocking or any other negative impact.

To ensure that, when moving the two clamping cylinders, both exert the same force onto the exterior or interior tubes that are to be fastened, the invention provides for the piston or ring surface of the parallel clamping cylinders to be connected in such a way that synchronism and contact pressure onto the boring rod are generated. This prevents one of the clamping cylinders from reaching the tube with its clamping jaw before the other and thus from applying different contact pressure.

The desired synchronism is achieved by selecting the parallel clamping cylinders with regard to piston and ring surface in such a way, preferably 100:60, that the selection safely results in the desired synchronism. Even in a parallel arrangement, or if shifting of the two cylinders should prove necessary for space reasons, one can still assure that in the end the same contact pressure is applied by the two clamping cylinders.

It was explained above that, after swiveling the drum magazine into the drilling axis, a vise-grip wrench that travels in the clamping mount's longitudinal axis is actuated. It fastens the exterior and interior tubes, or only the interior tube, and thus enables connection with the existing drill string. In order to avoid a pitched position and thus possible problems with fastening the two tubes or four tubes, the invention provides for a fastening clamp for the interior tube at the height of the upper edge of the clamping mount's drum magazine. This fastening clamp also has positive effects during connection with the existing drill string by keeping the interior tube in a separate position until the driving gear has seized the interior tube to obtain connection with the existing interior tube or tube string. After the interior tube has been connected, the exterior tube, which is held in place by the above-mentioned vise-grip wrench, can also be connected.

In one version of the invention, the fastening clamp is equipped with gripping pliers, whose clamping wings are designed to be swiveling via a cylinder against the force of retaining springs. When moving the cylinder up or out, the clamping wings are pushed apart in the back against the force of the retaining springs in order to be able to be pressed against the wall of the respective tube in front. It is also possible to forgo the retaining springs; however, swiveling or spring-back action of the clamping wings is slightly more difficult to achieve in this case.

The necessary pressing forces can already be accomplished along a very short path if the cylinder is equipped with a piston rod that has rollers on each end, and if these rollers are arranged and designed in such a way that they can be pressed against the interior surfaces of the clamping wings, with the surfaces being bent to favor opening and closing of the clamping wings. As mentioned above, this design offers the possibility of moving the clamping wings apart in the back and toward each other in the front area of the tube to be fastened. This is possible with the necessary force along a very short path if, as described, the rollers are guided along the appropriately bent inner surfaces.

According to the invention, strain normally placed onto the drum magazine during swiveling and when taking the respective drill strings out of the clamps is prevented through flexible suspension of the drum magazine's axis of rotation. When "loading" the exterior tubes with the interior tubes or when swiveling into the drilling axis, the drum magazine can be actuated so that the respective drill strings reach and maintain the correct position, without causing overloading of the axis of rotation.

According to the invention, the interior tubes are moved out of the drum magazine with the help of a clamping roller design when inserting them into the exterior tubes. In order to avoid tilt-out when lifting them and to maintain the best possible position, the invention provides for a funnel-shaped lead-in at the upper edge of the clamping mount for the interior tubes that are to be raised via the clamping roller design. This funnel-shaped lead-in can be used for final position guidance or also for intermediate positioning and offers the possibility of combining both in order to guarantee the best possible position of the interior tube on the clamping mount. These funnel-shaped lead-ins or final guidance devices above all prevent unfavorable forces from affecting the clamping roller design because the respective interior tube that is supposed to be pulled out runs the risk of tipping in an unexpected direction. The respective lead-ins do not hinder the remaining fixtures or devices around the clamping mount.

Insertion and removal of the interior tube with the clamping roller design occurs at an even pace and without problems even during unfavorable conditions if the clamping roller design has two driven rollers that are arranged opposite each other, which are designed in such a way that they press against the interior tube simultaneously and are traversable. The rollers preferably have a joint driving gear, which can be pneumatically operated or may also be an electric drive. The rollers are best arranged in such a way that they embrace the respective tube slightly and can make room, for example through incorporated sleeves, to ensure consistently safe fastening of the interior tube.

Safe fastening, for example also in the sleeve area, is guaranteed in particular if the rollers are designed as Sigma rollers conforming to the tube profile. These Sigma rollers have sufficient driving surfaces to guarantee generation of sufficient forces on the interior and simultaneously create a certain degree of control due to the bent shape of their running surfaces.

In a preferred version of the clamping roller design, the necessary pressing forces are generated by equipping the rollers with axle brackets, which are connected in a swiveling way with a retaining clip and at a distance to it with a spacer whose length is adjustable. The axle bracket can be swiveled back and forth as needed on the rigid retaining clip, with the spacer following this movement and simultaneously ensuring that via the axle bracket the necessary pressing forces can be generated onto the rollers or via the rollers onto the tube wall. Speaking theoretically, the spacers could be springs; however, pneumatic cylinders or similar components are better suited for ensuring spring-back and sufficient pressing. When inserting the interior tubes into the exterior tubes, the interior tubes should protrude slightly over the exterior tubes in order to be able to take hold of them with the fastening clamp or the vise-grip wrench. This is achieved by equipping the drum magazine on the base plate with guiding arbors which protrude towards the exterior tubes and mesh with them, and whose length should at least measure that of the fastening clamp's fastening length. Thus, through the clamping roller design, the interior tube slides into the exterior tube until the interior tube rests on the respective guiding arbor. The clamping roller design then loosens and moves back into its original position so that subsequently the inserted tubes can also be removed from the drum magazine. The guiding arbors' dimensions ensure that the fastening clamp, via which the interior tube is fastened into the drilling axis, can get an exact hold of the interior tube.

It was indicated above that exact guidance of the interior and exterior tubes is desirable for enabling safe connection with the existing drill string, which is fixed via the vise-grip wrenches. Since problems occur with even a slight offset, the existing invention proposes to resolve this issue through optimization of the entire fixture's operation by equipping the interior tubes, which have interior channels, with welded end pieces with interior or exterior threads that are sleeve-shaped and have corresponding insertion tapers. The welded-on end pieces offer the possibility of enlarging the interior channel, which so far had been rather limited in its diameter, so that accordingly more drilling fluid can be transported through the interior channel. In particular, however, the interior channel is designed to be even throughout so that the flow of the drilling medium is not influenced in the transition areas. At the same time, this version offers the opportunity of improving the insertion process of the interior tubes—an area where problems occur especially frequently—by providing for appropriate insertion tapers, i.e., the end piece with exterior thread has an appropriate insertion taper on the exterior collar, while the end piece with interior thread has the insertion taper at the insertion end. The two interior tubes are therefore connected in each other in a manner of speaking.

The forces generated when driving the boring rod into the soil are so great that sometimes considerable force is required to pull the exterior or interior tube string and thus loosen the individual tubes from each other. To resolve this issue, the invention provides for the end pieces' exterior and interior thread to end before the tapered area. This means that the surfaces of the two tubes that are to be connected with each other do not rest flush on top of each other by ensuring that a small space always remains between them due to the thread. This facilitates the loosening of tubes from each other.

Transport of the respective drilling medium or the drilling fluid is optimized by designing the end pieces in such a way that they maintain a diameter of at least 30 cm of the interior channel at approximately constant wall thickness. It is advantageous that the necessary wall thickness is guaranteed despite a very large interior channel; this ensures a long service life, which in turn guarantees optimized handling. Increases occurring in the outer diameter of the interior tubes carry no risk because a sufficient ring channel to the interior walls of the exterior tubes remains and because the clamping roller design used ensures safe gripping and holding of the interior tubes, even in the area of these sleeves.

A special feature of the invention is the fact that a fixture is created with which both single and double tube rods can be used. The interior and exterior tubes can be stored safely in the drum magazine without difficulty and separately from each other so that they can be used either separately or, if required, be inserted into each other in the drum magazine in order to be used as double tubes. Storing them separately furthermore has the advantage that the individual tubes can be stored in the drum magazine one after the other when pulling the drill string because the interior tube will always be the first to be pulled, followed by the exterior tube. It is advantageous that the tubes can be used separately due to storage in the drum magazine, but even more so that they can be used combined in a design, particularly when using the simple clamping roller design. Due to utilization of the drum magazine and the easy handling of the interior and exterior tubes, it is also possible to work with boring rods of a working length that exceeds the standard length of 1.5 m (60 inches). Compared to other products associated with this technology, stability is not affected because the two tubes are only allocated to one drum magazine of an appropriately limited length or height. Since only one individual interior tube needs to be raised for the insertion process, this cannot hinder the stability of an appropriate fixture. The same applies when pulling the drill string or boring rod because the tubes are only handled individually for storage in the drum magazine, which is located in a relatively low position.

Further details and advantages of the invention are found the following descriptions of the relevant drawings, in which preferred versions are shown with the necessary details and individual components. They show:

DETAILED DESCRIPTION

Figure 1:
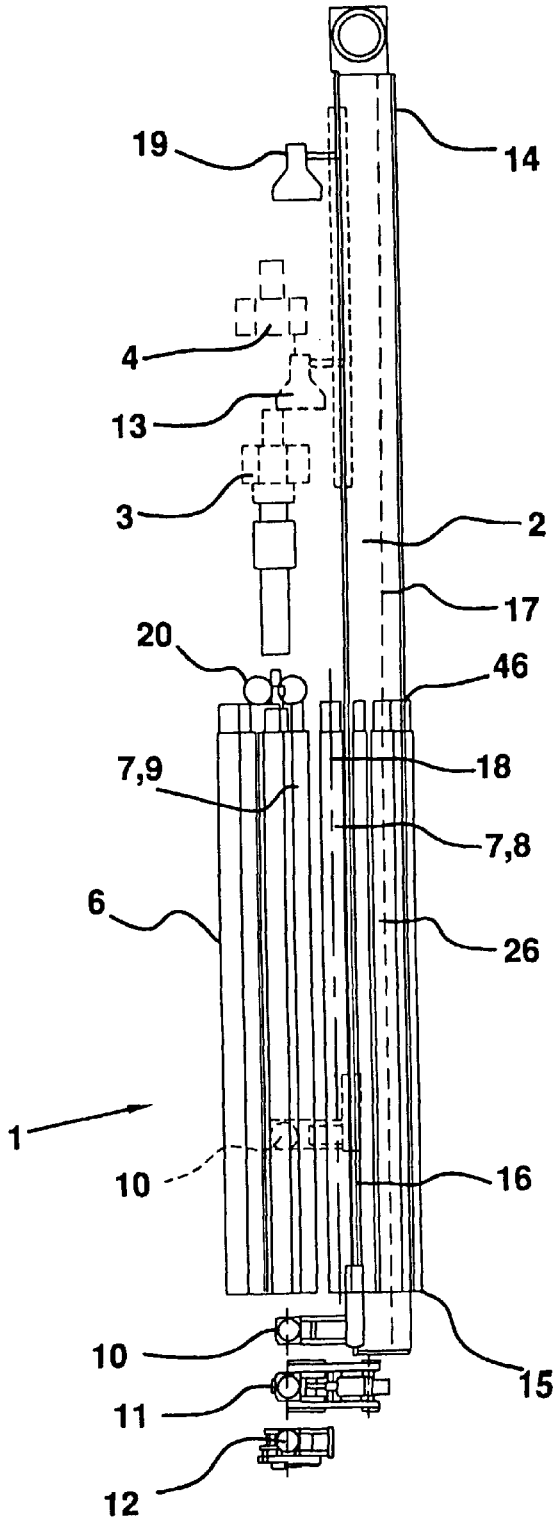
FIG. 1 side view of the clamping mount with a drum magazine for double tubes, FIG. 2 top view of the clamping mount with drum magazine in two working positions, FIG. 3 top view of the drum magazine with stored interior and exterior tubes, FIG. 4 top view of a movable vise-grip wrench with double cylinder design, FIG. 5 top view of a fastening clamp, FIG. 6 clamping roller design with interior tube, FIG. 7 clamping roller design with interior tube inserted into the exterior tube, FIG. 8 cross-sectional view of an interior tube with receiving end, and FIG. 9 the interior tube shown in FIG. 8 with shank end.

FIG. 1 shows a drill 1 in simplified form, forgoing familiar details such as tracklaying gear, cabin etc. It depicts the clamping mount 2, on which the driving gears 3 and 4 are arranged in such a way that they can travel in the longitudinal axis 17. The driving gear 3 drives the interior tube 9, and the driving gear 4 drives the exterior tube 8, which together form the boring rod 7 stored in the drum magazine 6.

The picture in FIG. 1 does not show clearly that the exterior tubes 8 and interior tubes 9 are arranged in groups distributed over the circumference of the drum magazine 6 while resting on the base plate 22 of the drum magazine 6.

The lower edge 15 of the clamping mount 2 is equipped with several vise-grip wrenches 10, 11, 12, which serve the purpose of either connecting the exterior tubes 8 with the exterior tube located in the hole, or the interior tubes 9 with the interior tube located in the hole, or loosening the individual parts when pulling the boring rod 7.

The upper edge 14 of the clamping mount 2 reflects a funnel-shaped lead-in 13 into which the interior tubes 9 are inserted when they are pulled out of their fastening position in the drum magazine 6 in order to then be inserted into the neighboring exterior tube 8. Appropriately, another second funnel-shaped lead-in 19 can be provided for along the length of the clamping mount 2, which would actually become the final guidance device, while the funnel-shaped lead-in 13 represents an intermediate position for the interior tube 9.

As mentioned above, the funnel-shaped lead-ins 13, 19 serve the purpose of guiding the interior tube 9 when it is moved out of the drum magazine 6 in order to then be inserted into an exterior tube 8. This process is aided by a clamping roller design 20, which is installed at the upper edge 46 of the drum magazine 6.

After inserting the interior tube 9 into the exterior tube 8, the drum magazine 6 is swiveled into the boring axis 26 where a vise-grip wrench 10 takes hold of and fastens it. The clamping axis 10 is located at the lower edge 15 of the clamping mount 2 and can travel over the entire path 16 in the longitudinal axis 18 of the tubes 8, 9 or in the longitudinal axis 17 of the clamping mount 2. The exterior tube 8, or also the interior tube 9, can be fastened in such a way that subsequently it can be connected with the exterior tube in the bore, or with the interior tube in the bore. This process is aided by further vise-grip wrenches 11, 12, which fasten the respective drill strings.

Figure 2:
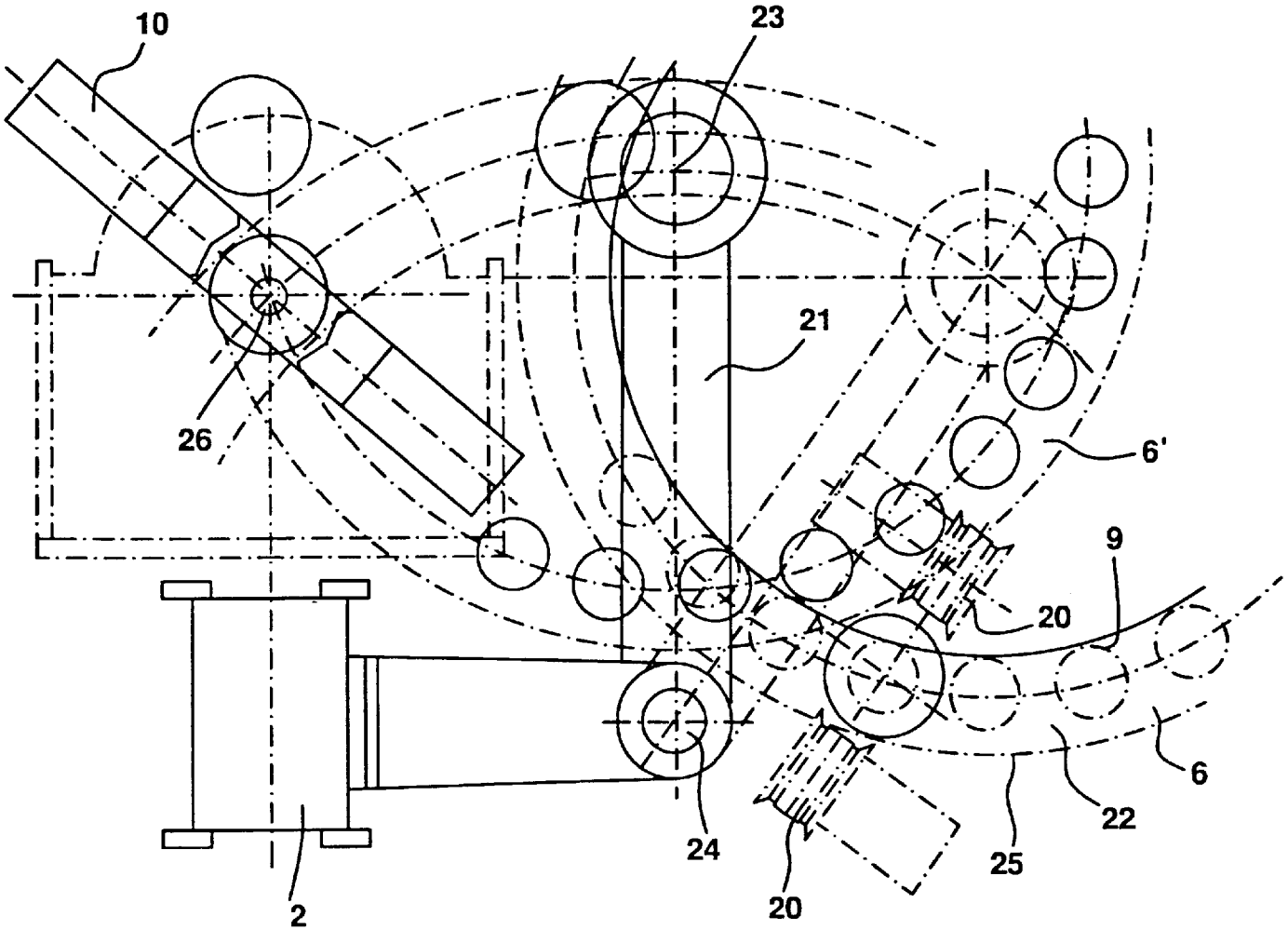

FIG. 2 indicates the swivel process by which the inserted exterior tubes 8 and interior tubes 9 are swiveled into the drilling axis 26, for which a swivel arm 21 is connected with the clamping mount 2; this arm can be swiveled around the axis of rotation 24 so that the respective combination of interior tube 9 and exterior tube 8 is located in the drilling axis 26. For this, a combination tube that is arranged on the drum circumference 26 can be used after the drum magazine 6 has been brought into the position shown in FIG. 2 via the swivel arm 21. The tube combination 8, 9 is then seized by the vise-grip wrench 10, which is also shown in FIG. 2.

FIG. 2 also indicates the position of the clamping roller design 20 and that of the axis of rotation 23, which are arranged and designed such that excess stresses are not a threat because they are suspended flexibly.

Figure 3:
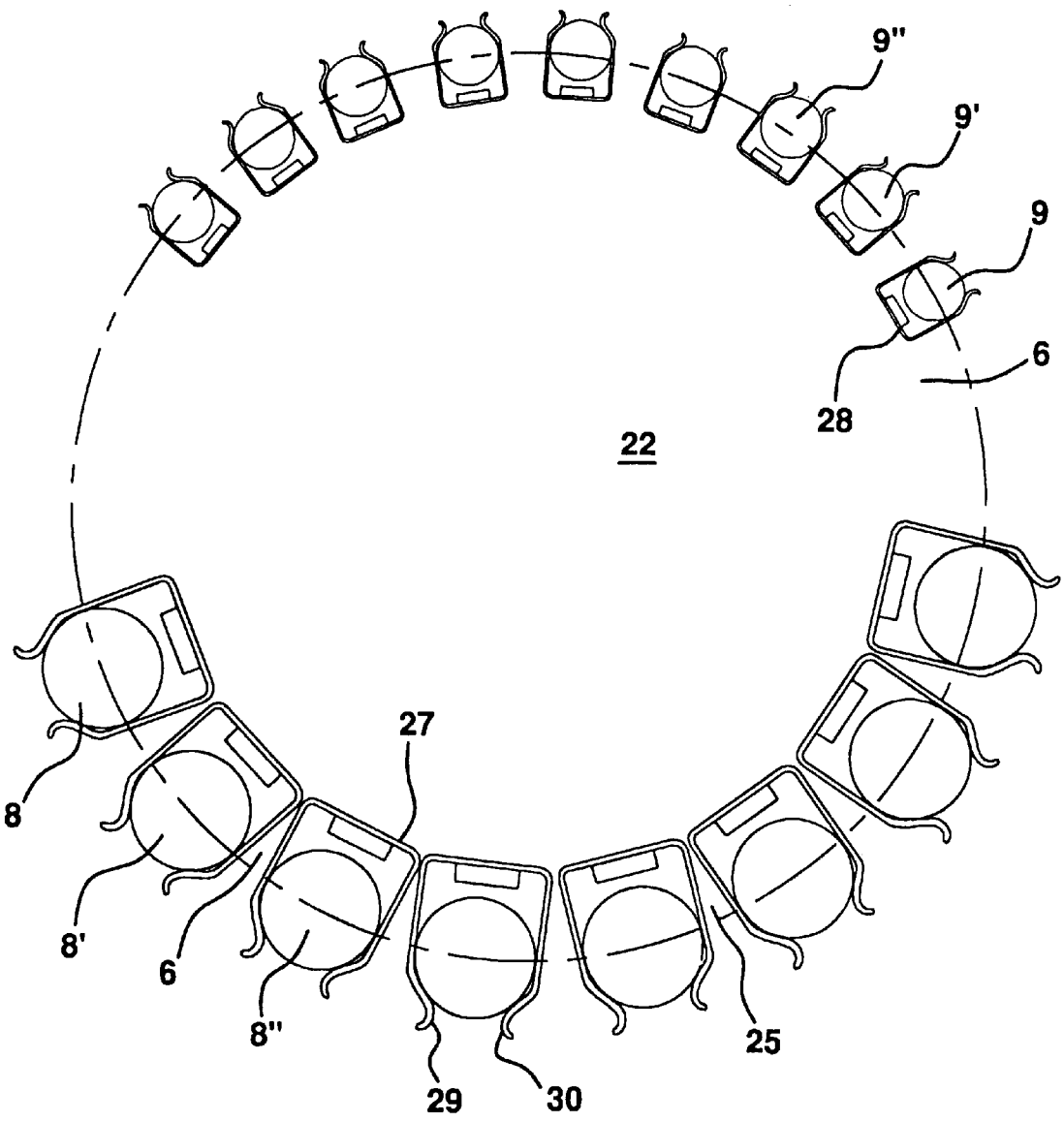

FIG. 3 depicts a drum magazine seen from above, clearly showing that the interior tubes 9, 9', 9" and the exterior tubes 8, 8', 8" are arranged in groups distributed over the drum circumference 25. They are held, respectively, by clamps 27, 28, which safely fasten the respective exterior tubes 8 or interior tubes 9 via their bent free ends 29, 30. This picture shows that the respective exterior tubes 8 and interior tubes 9 can be removed from their position after the drum magazine 9 is swiveled in front of the clamping mount 2 via the vise-grip wrench 10 in order to be connected in the drilling axis 26 with the existing drill string.

Figure 4:
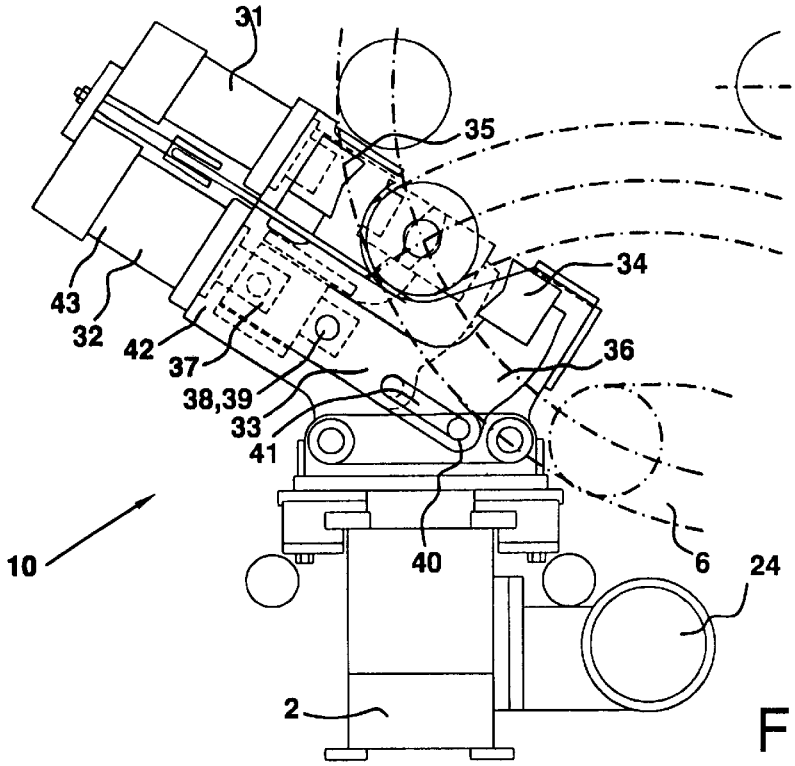

This vise-grip wrench 10 is shown in an enlarged version in FIG. 4, which is a special version of the picture in FIG. 2, differentiated by the fact that the clamping cylinders 31, 32 are located parallel next to each other. Nevertheless, this design can safely hold and fasten the respective exterior tube 8 or interior tube 9 because the clamping cylinder 32 is equipped with a deviating device 33. This makes it possible to safely fasten the respective tubes 8, 9 with these cylinders by moving the clamping jaws 34, 35 against each other. The clamping cylinder 32 therefore has an elbow 36, which is first connected with the piston 37 and second carries the clamping jaw 34 on the opposite side. Overstressing of the clamping cylinder 32 is prevented by connecting the elbow 36 with the piston 37 via a pin 39 and thus via a joint 38. Elongated holes are provided for in the angle arc 40, guaranteeing exact guidance of the elbow 36 during insertion or removal of the piston 37.

The piston surface 42 and the ring surface 43 on the clamping cylinders 31, 32 are designed in such a way that synchronism of both clamping cylinders 31, 32 is ensured.

Figure 5:
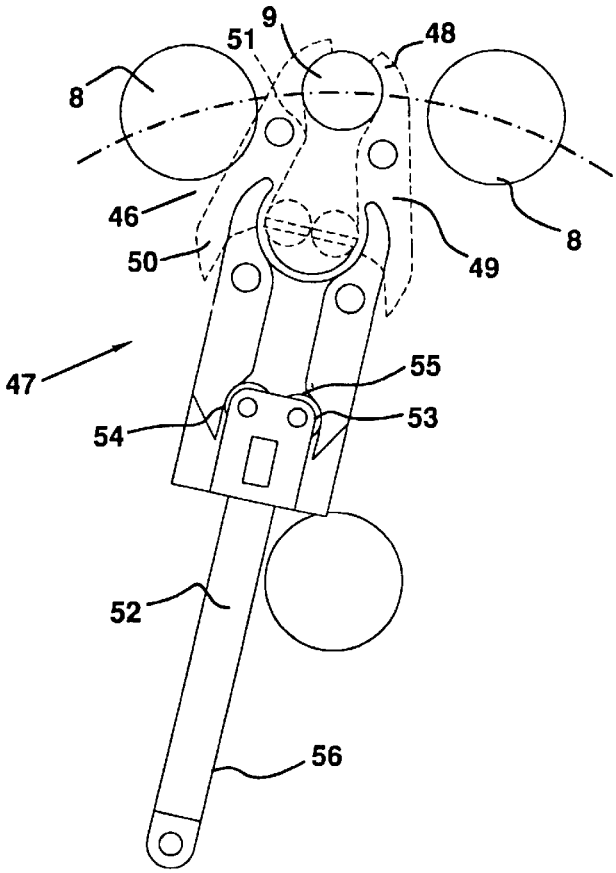

While the exterior tube 8 is fastened in the lower partial area of the mounting clamp 2 with the vise-grip wrench 10, the fastening clamp 47 depicted in FIG. 5 serves the purpose of fastening and handling the interior tube 9. According to FIG. 5 this fastening clamp 47 is equipped with gripping pliers 48 with clamping wings 49, 50, which ensure exact fastening of the interior tube 9. At the end of the clamping wings 49, 50 opposite that of the gripping surface, which can be held together via a retaining spring 51 in this area, a cylinder 56 is arranged with a piston rod 52, which has rollers 53, 54 on both ends that can travel between the clamping wings 49, 50. The interior surfaces 55 of the clamping wings 49, 50 are designed in such a way that the clamping wings 49, 50 open in this area and close in the area of the gripping surfaces if the piston rod 52 moves out far enough. Due to the interior surfaces 55, the travel path is relatively small. FIG. 5 depicts this appropriately with a solid and a dotted line.

Figure 6:
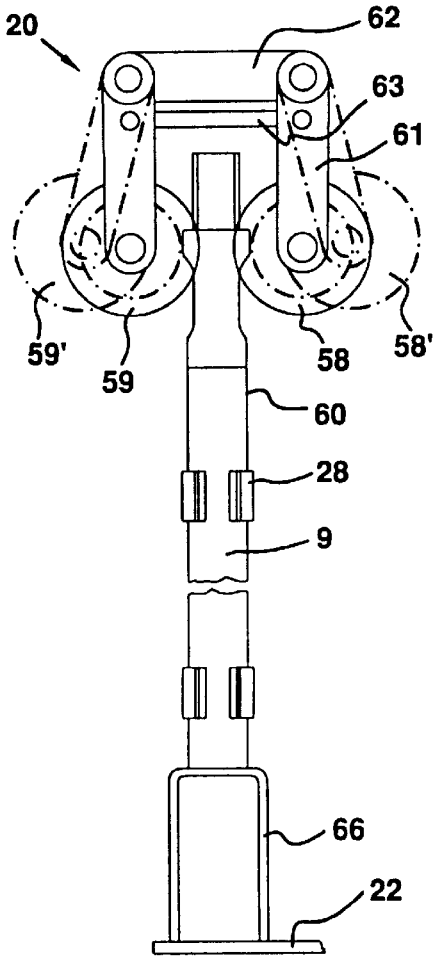
Figure 7:
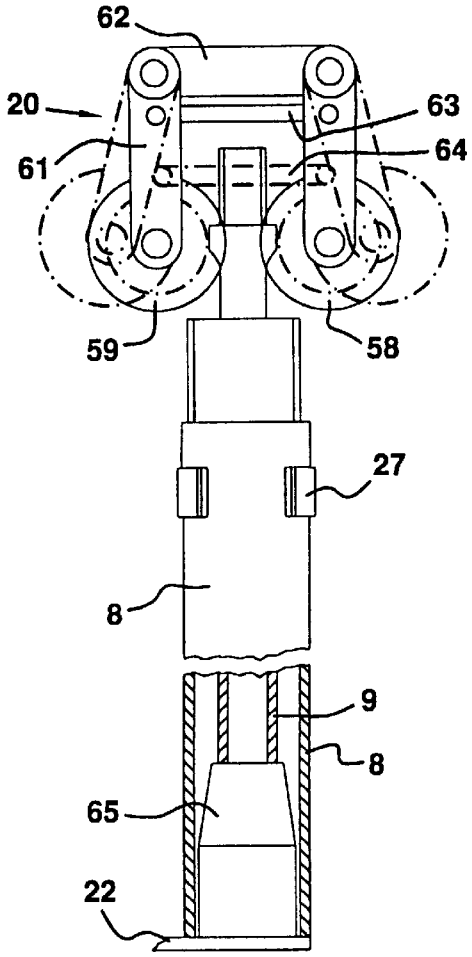

As mentioned above, the individual interior tubes 9 are taken or pulled out of the drum magazine via a clamping roller design 20 in order to then be lowered into the next exterior tube 8 or a selected exterior tube 8 until the position indicated in FIG. 7 has been reached. While FIG. 6 shows the starting point, with the interior tube 9 resting on a supporting frame 66 which in turn is connected with the base plate 22, FIG. 7 depicts the exterior tube 8 standing directly on the base plate 22. FIG. 6 shows the clamps 28 via which the interior tube 9 is fastened in the drum magazine, with these clamps 28 basically corresponding to clamps 27 in FIG. 7 for the exterior tube 8.

FIG. 7 additionally shows the situation after the interior tube 9 and exterior tube 8 have been inserted into each other, with the guiding arbor 65 on the base plate 22 ensuring that the interior tube 9 protrudes somewhat from the exterior tube 8 once the clamping roller design's 20 work has been completed.

This clamping roller design 20 consists of two rollers 58, 59, which are arranged close to the tube profile 60. They are fastened via axle brackets 61, which in turn have an articulating connection with a rigid retaining clip 62. A spacer 63 or 64 is arranged at a distance to the retaining clip 62 via which the two axle brackets 61 can be moved towards each other to ensure a close fit of the rollers 58, 59 on the interior tube 9. The spacers 63 and 64 can be air cylinders, a similar cylinder, or springs; however, it must be ensured that the rollers 58, 59 are not too close together so that the interior tube 9 can still be pushed through.

Figure 8:
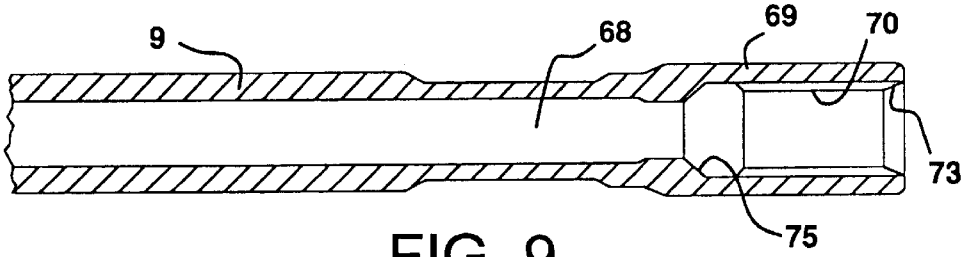
Figure 9:
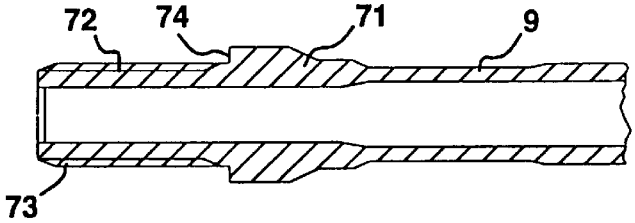

FIGS. 8 and 9 finally show a special version of an interior tube 9, which—as can be seen—has an interior channel 68 of large diameter. The interior tube 9 is equipped with welded-on end pieces 69 with interior thread 70, which can be connected with the exterior thread 72 of the neighboring welded-on end piece 71. For easier insertion, tapers 73 are provided for, which are shaped accordingly on the welded-on end pieces 69, 71 to basically achieve a funnel-shaped lead-in. To prevent interior tubes 9 that have been connected with each other from remaining stuck, the welded-on end piece 69 as well as the welded-on end piece 71 both have tapers 74, 75 that are arranged in such a way that the respective thread 70, 72 ends sufficiently far away from them so that corresponding surfaces remain at a distance from each other, i.e. without them running the risk of getting stuck inside each other.

The welded-on end piece 69 can also be described as the receiving end and the welded-on end piece 71 as the shank, with the described version achieving that a jamming during the insertion process of the tube ends is at least less likely, if not completely avoided, so that this improves the handling of such tubes considerably.

All features that have been quoted, in addition to those that are only included in the drawings, are considered part of the invention, both by themselves and in combination with each other.

I claim:

1. Fixture for producing bores comprising a clamping mount with movable driving gears, a boring rod connected to the gears for driving into and out of the bores, interior and exterior tubes in the boring rod, a drum magazine for the interior and exterior tubes, a clamping mount parallel to the drum magazine, traversable around an axis of rotation and swiveling along a longitudinal axis of the clamping mount, and plural vise-grip wrenches communicating with the clamping mount for tightening and loosening the boring rod, wherein one vise-grip wrench is on a lower end of the clamping mount along the longitudinal axis and arranged movably corresponding to a swiveling and traversable movement of the drum magazine, the interior and exterior tubes being removable radially from the drum magazine, and wherein the drum magazine has a clamping roller design for raising and lowering the interior tube.

2. The fixture of claim 1, wherein the vise-grip wrenches is arranged on the clamping mount via a guided travel path of about 1 to 2 meters (about 40 to 80 inches).

3. The fixture of claim 2, wherein the path is 1 m.

4. The fixture of claim 1, further comprising clamps for fastening the boring rod in the drum magazine, wherein the clamps are arranged and designed such that the interior and exterior tubes are distributed in a radial direction either separately or in groups over a circumference of the drum magazine.

5. The fixture of claim 1, wherein the one vise-grip wrenches are movable, further comprising clamping cylinders for actuating the vise-grip wrenches, the clamping cylinder being parallel to each other and a deviating device on one of the clamping cylinders.

6. The fixture of claim 5, wherein the deviating device has an elbow having clamping jaws, the elbow being connected with a piston and ring of the clamping cylinder in an articulating manner.

7. The fixture of claim 6, further comprising a pin for connecting the elbow to the piston, and wherein the elbow has elongated holes in an angle arc.

8. The fixture of claim 5, wherein the piston of the parallel clamping cylinders are connected to result in synchronism and contact pressure onto the boring rod.

9. The fixture of claim 8, wherein the parallel clamping cylinders are selected to have a ratio with that of a surface of the piston and ring having of about 100:60 for creating the synchronism.

10. The fixture of claim 1, further comprising a fastening clamp for the interior tube provided at a height of an upper edge of the clamping mount and drum magazine.

11. The fixture of claim 10, wherein the fastening clamp has gripping pliers with clamping wings designed to swivel over a cylinder against a force of retaining springs.

12. The fixture of claim 11, wherein the cylinder comprises is a piston rod with rollers on opposite ends, wherein the rollers are arranged and designed for pressing against interior surfaces of the clamping wings, wherein the surfaces are bent for opening and closing of the clamping wings.

13. The fixture of claim 1, wherein an axis of rotation of the drum magazine is provided in an articulating manner.

14. The fixture of claim 1, further comprising a funnel-shaped lead-in into the interior tube on an upper end of the clamping mount, and a clamping roller design for raising the lead-in.

15. The fixture of claim 14, wherein the clamping roller design comprises two driven rollers located opposite each other, for pressing against the interior tube simultaneously and for being traversable.

16. The fixture of claim 15, wherein the rollers are Sigma rollers conforming to profiles of the tubes.

17. The fixture of claim 15, wherein the rollers comprise axle brackets connected in a swiveling way with a retaining clip and a spacer connected distal from the clip, wherein a length of the brackets is adjustable.

18. The fixture of claim 1, further comprising a base plate for the drum magazine, exterior tubes on the base plate and guiding arbors reaching into the tubes, with a length of the arbors being at least same as a fastening length of the fastening clamp.

19. The fixture of claim 1, wherein the interior tubes have interior channels having welded end-pieces with interior and exterior threads, the end-pieces being are sleeve-shaped and having corresponding insertion tapers, respectively.

20. The fixture of claim 19, wherein the interior and exterior threads on the end pieces end before the tapers.

21. The fixture of claim 19, wherein diameters of the interior channels are at least 30 cm (12 inches) at approximately even wall thickness.

* * * * *

UNITED STATES PATENT AND TRADEMARK OFFICE

CERTIFICATE OF CORRECTION

PATENT NO. : 6,164,391 
DATED : December 26, 2000
INVENTOR(S) : Thomas Wurm

It is certified that error appears in the above-identified patent and that said Letters Patent is hereby corrected as shown below:

Title page,
Item [73], "Klenn Bohrtechnik Zweigenieder Lassung der Bauer Spezialtiefbau GmbH" should be -- Klemm Bohrtechnik Zweigniederlassung der Bauer Spezialtiefbau GmbH --.

Signed and Sealed this

Eighteenth Day of November, 2003

JAMES E. ROGAN
*Director of the United States Patent and Trademark Office*